United States Patent [19]

Lee

[11] Patent Number: 4,622,869

[45] Date of Patent: Nov. 18, 1986

[54] SUCKER ROD RATCHET WRENCH

[76] Inventor: Kenneth W. Lee, 2729 Halifax, Odessa, Tex. 79762

[21] Appl. No.: 776,648

[22] Filed: Sep. 16, 1985

[51] Int. Cl.[4] ..... B25B 13/46

[52] U.S. Cl. ..... 81/52; 81/57.39; 81/57.46

[58] Field of Search ..... 81/52, 54, 57.39, 57.46; 51/58.2, 58.5, 484, 487

[56] References Cited

U.S. PATENT DOCUMENTS 775,733 11/1904 Pipher ..... 81/52

878,388 2/1908 Heimann ..... 81/58.5

*Primary Examiner*—James G. Smith

*Assistant Examiner*—Maurina Rachuba

*Attorney, Agent, or Firm*—Wendell Coffee

[57] ABSTRACT

A ratchet barrel is placed upon the lower half of sucker rod joint. A wrench is placed upon the upper half of the joint. A torque handle is pivoted to the wrench. A pawl upon the torque handle engages a ratchet wheel upon the barrel to tighten or loosen the joint. A stop upon the wrench permits the wrench to be rotated by the torque handle without the assistance of the ratchet and pawl mechanism.

4 Claims, 5 Drawing Figures

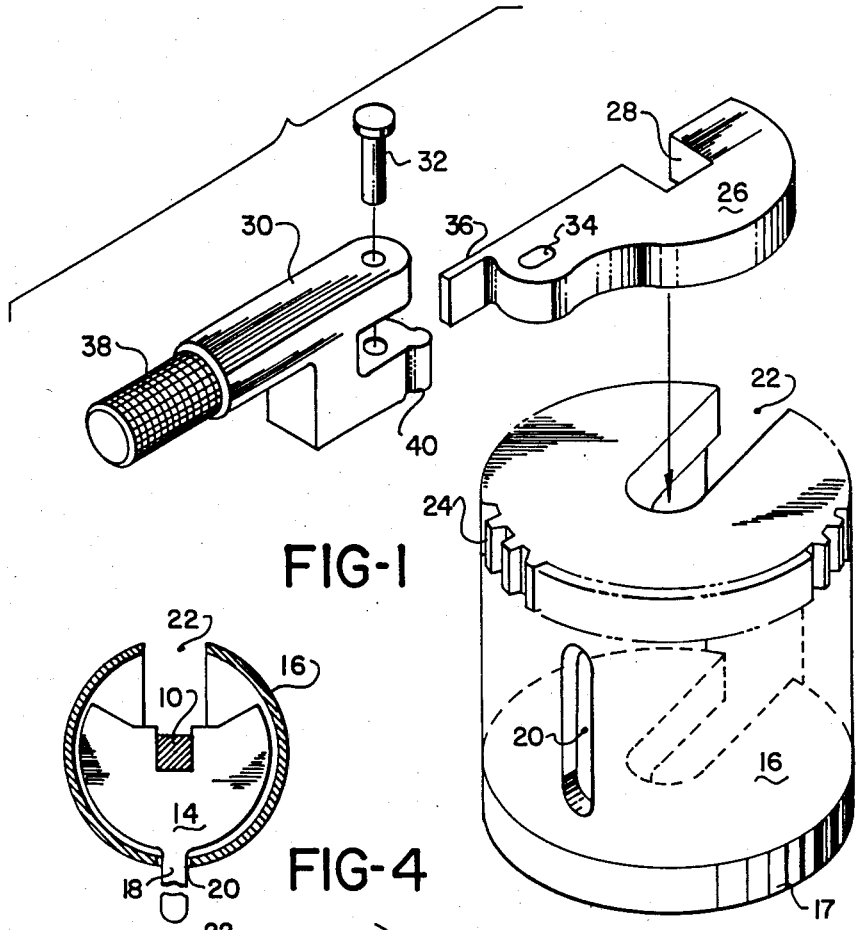
FIG-1
FIG-4
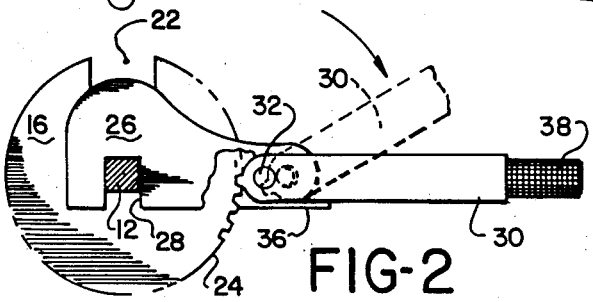
FIG-2
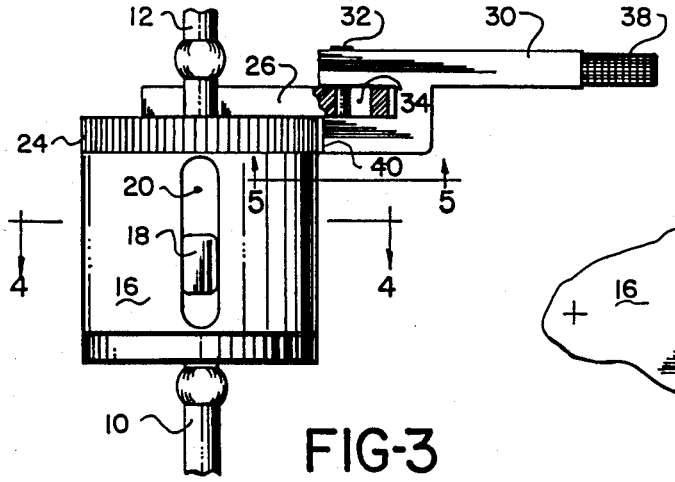
FIG-3
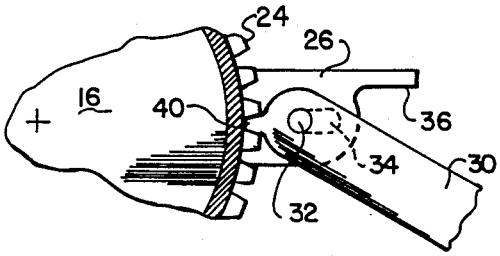
FIG-5

SUCKER ROD RATCHET WRENCH

CROSS REFERENCE TO RELATED APPLICATIONS

None.

BACKGROUND OF THE INVENTION (1) Field of the Invention

The invention relates to tools and more particularly to hand held ratchet wrench.

(2) Description of the Prior Art

Sucker rods often or normally have square fittings upon which hand held wrenches may be attached. Before this invention the normal procedure to connect or disconnect the rods was to attach one wrench to the lower section of the sucker rod and another wrench to the upper section of the sucker rod and have sufficiently long handles upon the wrenches so that manual force applied to the end of the wrench supplied sufficient torque to tighten the joint or to loosen it.

Also in making up threaded pipe joints the same practice was followed. However, normally a movable jaw type wrench having teeth was used to grip cylindrical pipes.

In oil well practice with heavy pipes or drill stem it is customary to use a motor driven wrench or tong to rotate and tighten the pipes. Even on light tubing or sucker rods motor driven wrenches were known to the art.

When connecting or disconnecting tubing, pipe, or sucker rod in a well it was known to place slips above the surface of the earth to prevent the elongated elements (tubing, pipe, or sucker rod) from falling in the well and prevent rotation.

Before this application was filed, a search was made in the United States Patent and Trademark Office. That search developed the following patents:

| | |
|---|---|
| HARPER ET AL | 466,232 |
| ANSORGE | 766,577 |
| ROCHE | 1,670,214 |
| PETERSON ET AL | 2,456,838 |
| KOSTKA | 3,009,372 |
| MORROW | 3,448,641 |

KOSTKA discloses a slidable pawl ratchet type wrench. It is designed to drive a lug to fit within a socket for nuts, bolt heads, or the like. For the purpose of ratcheting a slot was provided between the wrench head and the torque handle so that the pawl could engage a ratchet wheel directly attached to the square lug.

HARPER ET AL discloses a similar slidable pawl ratchet type wrench except that instead of driving a square lug for a socket, he drives a diferent type of work engagement means.

PETERSON ET AL discloses a hand held ratchet wrench which has a radially slotted head and socket. The radially slotted socket can engage the work and socket be rotated by pawls upon the radially slotted head. The entire tool is designed to connect to a single nut.

The additional three patents appear not to be as pertinent as the specific patents discussed above. They are included only because the applicant believes the Examiner would be interested in any art reported by an experienced searcher.

SUMMARY OF THE INVENTION (1) New and Different Function

I have invented an improved wrench for use with sucker rods and other elongated coaxial elements such as tubing, drill stem, pipes, and the like.

This invention utilizes parts attached to the two coaxial elements to be connected together. A ratchet wheel is attached coaxially to one element. A wrench is attached to the other. A torque handle is pivoted to the wrench. The torque handle has a pawl which cooperates with the ratchet wheel. Thereby the pivot and the ratchet wheel operates as a level and fulcrum so that a mechanical advantage is obtained to multiply the torque applied to tighten or loosen the joint.

I choose to use a pawl rigidly fixed to the torque handle so that with a slotted pivot a very rugged tool is produced with a minimum amount of working parts or "trigger work" which can fail as a result of rough handling or poor maintenance. Also a stop is provided between the wrench and its pivoted torque handle so that the torque handle can be used as a extension of the wrench to quickly run the threads of the two elements together before the mechanical advantage of the pawl and ratchet wheel is used to increase the torque applied to the joint.

Thus it may be seen that the total function of my invention far exceeds the sum of the functions of the individual parts such as wrenches, ratchet wheels, pivots, etc.

(2) Objects of this Invention

An object of this invention is to connect and disconnect threaded joints of elongated coaxial elements.

Further objects are to achieve the above with a tool that is sturdy, compact, durable, lightweight, simple, safe, efficient, versatile, ecologically compatible, energy conserving, and reliable, yet inexpensive and easy to manufacture, operate and maintain.

Other objects are to achieve the above with a method that is versatile, ecologically compatible, energy conserving, rapid, efficient, and inexpensive, and does not require skilled people to operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 1 is an exploded perspective view of a tool according to my invention.

FIG. 2 is a top plan view of the tool engaged with a sucker rod with parts broken away for clarity.

FIG. 3 is a side elevational view of the tool engaged with a sucker rod with parts broken away for clarity.

FIG. 4 is a cross sectional view showing the barrel jaw within the barrel, taken on line 4—4 of FIG. 3.

FIG. 5 is a partial sectional view taken on line 5—5 of FIG. 3 showing the pawl engaged with the ratchet wheel.

DESCRIPTION OF THE PREFERRED EMBODIMENT

As may be seen there is represented a joint between two elongated coaxial elements threaded together in the form of sucker rod. The sucker rod has a bottom section 10 and a top section 12.

Those having skill in the well arts will recognize that the bottom section can be held against axial movement and also to some extent against rotational movement by slips at the well head where the sucker rod emerges from the well.

According to this invention, barrel jaw 14 is attached to the wrench flats of the bottom section 10. The barrel jaw forms means for attaching cylindrical barrel 16 coaxially to the bottom section 10. The barrel jaw is removably attached within the barrel so that the jaw may be replaced for different type and size elongated elements. The barrel bottom 17 is removable for this purpose. The jaw 14 is held within the barrel by jaw tang 18 extending through the tang slot 20 in the barrel 16 (FIG. 4).

Rod slot 22 is diametrically opposed from the tang slot 20. The rod slot permits the barrel 16 to be moved laterally onto the sucker rod and laterally away from the sucker rod.

Ratchet wheel 24 is formed in the top of the barrel 16 and is coaxial with the barrel 16, which attached to the bottom section 10 will be coaxial therewith. Since the top section 12 is caoxial with bottom section 10, then the ratchet wheel 24 will also be coaxial with the top section 12.

Wrench 26 is attached by wrench jaw 28 to the top section 12 of the sucker rod. Torque handle 30 is pivoted to the wrench 26. The torque handle will be biforcated at the point of pivoting so that the torque handle 30 will extend above and below that portion of the wrench 26. A round hole extends through the biforcated portion to receive pivot pin 32. The wrench 26 will have elongated wrench slot 34 to receive the pivot pin 32. The wrench slot 34 is outboard or distal of the ratchet wheel 24. Handle stop 36 is on the wrench 26 outboard of the wrench slot.

It may be seen that if the handle 30 is pulled outwardly or distally of the wrench 26 that the top section 12 may be rotated by the torque handle 30 pushing against the handle stop 36 to rotate the wrench 26. Force would be applied at hand hold area 38 of the torque handle 30. Therefore it may be seen that the torque which would be applied to the top section 12 would be the force at the hand hold area times the distance from the hand hold area to the center of the wrench jaw 28 which would of course the axis of the elongated elements 10 and 12.

It may be seen if the torque handle 30 is oscillated so that it is away from the handle stop 30 and the torque handle 30 is moved toward the ratchet wheel pawl, 40 on the handle 30 engages the ratchet wheel 24. The torque handle then functions as a lever with the pawl 40 against the ratchet wheel 24 being the fulcrum. Therefore, a much larger torque will be applied to the slot 34 of the wrench, when the torque handle is rotated toward the handle stop 36.

To illustrate the mechanical advantage of the implement measurements will be assumed. The distance from the axis of the two elongated elements 10 and 12 to the elongated slot 34 is about 12 inches. The distance from the pivot pin 32 to the hand hold 38 is about 12 inches. When the pawl 40 is engaged with the ratchet wheel 24 the distance from the pivot pin 32 to the ratchet wheel 24 is about one inch. Calculations will show if the torque handle is pulled away from the axis of the sucker rod and a 50 pound force applied to the hand hold that about 100 foot pounds of torque would be applied to the sucker rod. If the the torque handle is pushed toward the sucker rod so that the pawl is engaged with the ratchet wheel that 50 pounds force applied to the hand hold of the torque handle will theoretically result in 600 foot pounds of torque applied to the sucker rod. Actually slightly less torque will be applied because of frictional losses.

Also it may be seen that with the pawl 40 engaged with the ratchet wheel 24 that the torque is applied between the wrench jaw 28 and the barrel jaw 14. I.e., the slips holding the bottom section of the sucker rod 10 from falling in the well are not relied upon to resist the entire torque applied to the top section 12. The tang 18 would extend from the barrel 16 about the same distance as the torque handle 30.

The drawings have been used to illustrate the tool to be used in connecting and tightening the elongated elements (assuming they all have right hand threads). If it is desired to use the tool to loosen or disconnect the elongated elements then the pivot pin 32 is removed and the wrench turned upside down from its former position. Therefore it may be seen in this position that the handle stop 36 will be in the correct position to hold the torque handle 30 to disconnect the threaded joint between the elongated elements. It will also be understood that for different size wrench squares a different top wrench could be provided having different size wrench jaw 28. Also that the removable barrel jaw 14 could be removed by removing the bottom 17 and another such barrel jaw used having a proper size jaw.

Although not shown, those having ordinary skill in the art will understand that pipe wrench type jaws which grip the elongated elements with the application of torque could be used. These type jaws customarily have teeth and provisions for the opposing jaws to be pivoted one to the other so that rotation increase the pressure. Of course, if these type of jaws were also used as the barrel jaw 14, the jaws would require reversing for connecting and disconnecting the elongated elements.

Furthermore it may be seen that when the joints such as the sucker rod are firmly connected with the torque handle extended (100 foot pounds torque in the above example) then it is a simple matter to measure the additional movement obtained by the use of the ratchet and pawl. It is only necessary to count how many teeth are moved forward on the ratchet wheel to determine the additional rotation of the threaded joint between the two elements that are being screwed together.

Also the ratchet wheel 24 has been shown with square teeth or gear teeth so that the same ratchet wheel could be used for either connecting or disconnecting threaded joints. Those with ordinary skill in the art will recognize that the barrel could be provided with two ratchet wheels, the ratchet wheel on one end having sloped or angled teeth which would operate only when connecting the elongated elements and the ratchet wheel on the opposite end having sloped or angled teeth in the opposite direction which would operate only when disconnecting the element. An appropriate pawl on the torque handle would also be used.

The pivot represented by the pin 32 and the ratchet wheel 24 operates as part of a lever and fulcrum so that a mechanical advantage is obtained to multiply the torque applied to tighten or loosen the joint. The torque handle 30 functions to pry the wrench 26.

Also it will be noted that the elongated tang slot 20 is longer in the axial direction than the axial dimension of the tang 18. Therefore, the barrel 16 may be moved up and down so that the pawl 40 will properly fit with the ratchet wheel 24.

Therefore it may be seen that I am providing a tool which greatly aids in connecting and disconnecting of two elongated coaxial elements at a threaded joint between them.

The embodiment shown and described above is only exemplary. I do not claim to have invented all the parts, elements, or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing the following catalog of elements is provided:

Catalog of Elements

10 bottom section
12 top section
14 barrel jaw
16 barrel
17 barrel bottom
18 tang
20 tang slot
22 rod slot
24 ratchet wheel
26 wrench
28 wrench jaw
30 torque handle
32 pivot pin
34 wrench slot
36 handle stop
38 hand hold
40 pawl

I claim as my invention:

1. A tool for connecting and disconnecting two elongated coaxial elements threaded together along their axes comprising:

a. a ratchet wheel on and coaxial with
b. a barrel,
c. the barrel having a rod slot so that the barrel may be placed coaxially on one of the coaxial elements with the ratchet wheel coaxial to the elements,
d. barrel jaw means for attaching the barrel to the coaxial elements upon which it is placed,
e. a wrench with wrench jaw means for attaching the wrench to the other of the coaxial elements,
f. an elongated torque handle extendably radially of the wrench,
g. a pawl on the handle engaging the ratchet wheel, and
h. a removable pin extending through at least one hole in
e. a pivoted end of said torque handle,
j. said pin also extending through
k. a radially extending slot in the end of the wrench fitting at the joint to the torque handle, thus forming
l. pivot means innerconnecting the wrench and handle for pivoting the handle to the wrench so that the pawl may engage and disengage the ratchet wheel upon movement of the handle within the radially extending slot.

2. The invention as defined in claim 1 including all of the limitations a. through l. with the addition of the following limitations:

m. said barrel jaw means detachable from the barrel and having
n. a tang which extends through
o. a tang slot in the barrel diagonally opposed the rod slot in the barrel.

3. The invention as defined in claim 1 including all of the limitations a. through l. with the addition of the following limitation:

m. a stop flange on the lever for stopping the pivoting movement of the torque handle to the wrench when the torque handle is extending about radially of the elongated coaxial elements.

4. The invention as defined in claim 3 including all of the limitations a. through m. with the addition of the following limitations:

n. said barrel jaw means detachable from the barrel and having
o. a tang which extends through
p. a tang slot in the barrel diagonally opposed the rod slot in the barrel, and
q. said torque handle being biforcated at its pivoted end.

* * * * *